US005950611A

United States Patent [19]

Lopez et al.

[11] Patent Number: 5,950,611

[45] Date of Patent: Sep. 14, 1999

[54] PAINTBALL GUN HAVING MOVABLE COMPRESSED GAS TANK

[75] Inventors: Lamar L. Lopez, Arlington; Jay Skilling, San Antonio, both of Tex.

[73] Assignee: LX3 Corporation, Arlington, Tex.

[21] Appl. No.: 08/990,485

[22] Filed: Dec. 15, 1997

[51] Int. Cl.[6] ..... F41B 11/02

[52] U.S. Cl. ..... 124/72; 124/73; 124/74

[58] Field of Search ..... 124/72, 73, 74, 124/75, 76, 77

[56] References Cited

U.S. PATENT DOCUMENTS

| | | | |
|---|---|---|---|
| 4,073,280 | 2/1978 | Koehn et al. | 124/72 |
| 4,770,153 | 9/1988 | Edelman | 124/72 |
| 4,819,609 | 4/1989 | Tippmann | 124/72 |
| 4,890,597 | 1/1990 | Ekstrom | 124/74 |
| 5,265,582 | 11/1993 | Bhogal | 124/73 |
| 5,333,594 | 8/1994 | Robinson | 124/73 |
| 5,339,791 | 8/1994 | Sullivan | 124/73 |
| 5,462,042 | 10/1995 | Greenwall | 124/76 |
| 5,755,213 | 5/1998 | Gardner, Jr. et al. | 124/73 |

*Primary Examiner*—J. Woodrow Eldred
*Attorney, Agent, or Firm*—Haynes and Boone, LLP

[57] ABSTRACT

A paintball gun system in which the compressed gas tank coupled to the paintball ejection system is mounted to a lower side surface of a paintball gun such that the compressed gas tank may be moved relative to the paintball gun. An attachment member which couples the two includes a first part having a surface mounted to a lower side surface of the paintball gun and a second part having a surface mounted to an upper side surface of the compressed gas supply system. To reposition the compressed gas tank, the second part of the attachment member is repositioned relative to the first part. By moving the paintball gun relative to the compressed gas supply system, the vertical profile of the paintball gun system is reduced.

16 Claims, 2 Drawing Sheets

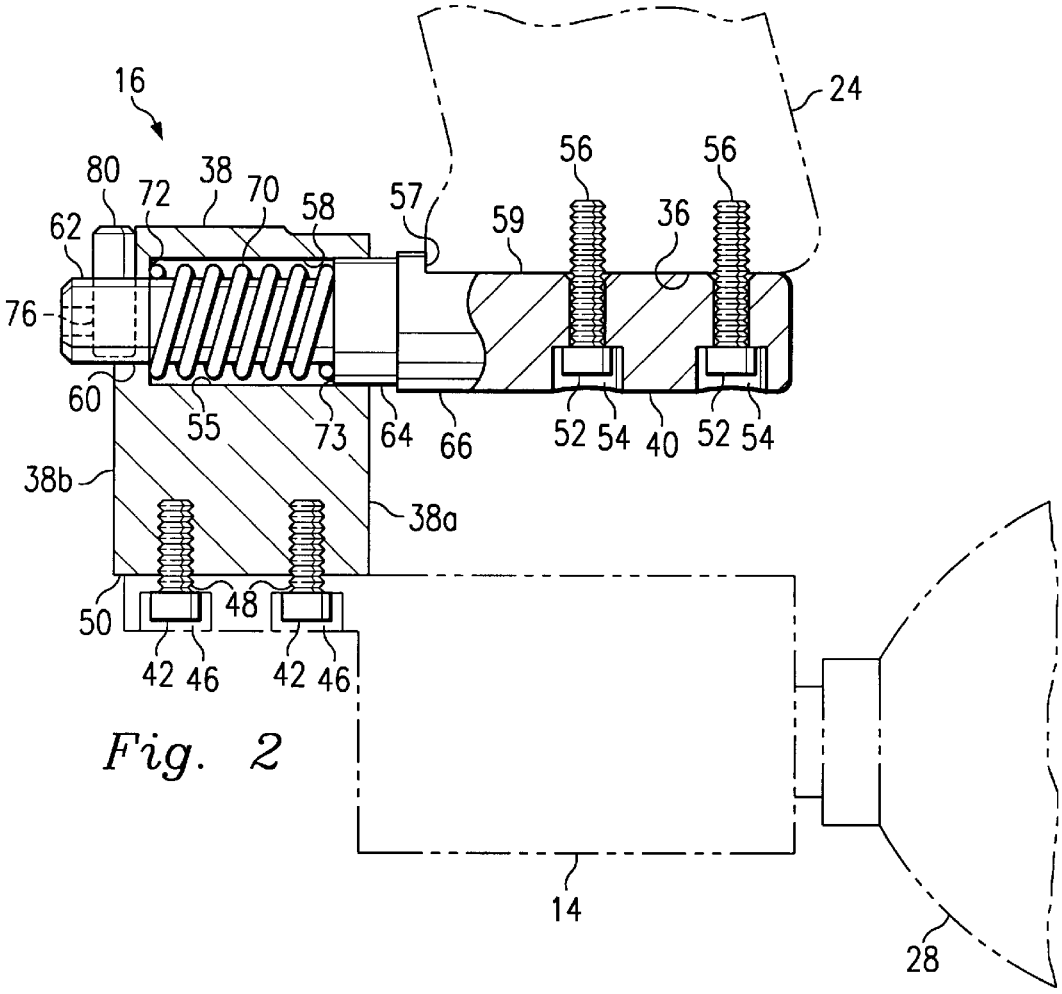
Fig. 2
Fig. 3
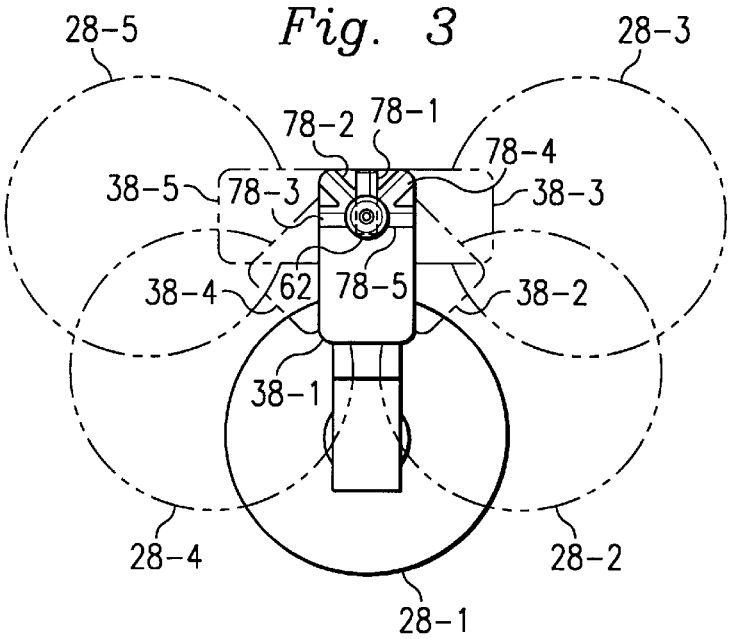

PAINTBALL GUN HAVING MOVABLE COMPRESSED GAS TANK

TECHNICAL FIELD

The invention relates generally to gas-powered paintball guns and, more particularly to a gas-powered paintball gun having a movable compressed gas tank.

BACKGROUND OF THE INVENTION

The sport of paintball has enjoyed great success in recent years. In the game, each one of two or more teams try to capture the opposing team's flag. The players on the teams each carry a gas-powered gun that shoots paintballs—gelatin covered spherical capsules which contain a colored liquid—a considerable distance. When a player is hit with a paintball fired from a gun, the paintball ruptures and leaves a colored "splat" on the hit player who is then "out" and must leave the game.

Central to the sport is the paintball gun. While paintball guns of various designs are commercially available, all paintball guns have certain common features. A typical paintball gun includes a gun barrel from which paintballs are ejected, an in-feed tube which provides access to the gun barrel, a loader which is mounted to the in-feed tube and supplies paintballs to the barrel via the in-feed tube, a compressed gas tank mounted to the body of the paintball gun, a conduit which couples an outlet valve of the compressed gas tank and the barrel and a trigger, the actuation of which causes the delivery of compressed gas to the barrel to forcibly eject a paintball therefrom.

The location on the paintball gun where the compressed gas tank is mounted will vary depending on the design of the particular paintball gun. In a number of designs, the compressed gas tank is either mounted to or otherwise incorporated as part of a rear stock portion of the paintball gun typically used as a shoulder rest. Handling of a paintball gun configured in this manner is quite similar to handling a rifle. However, as the dimensions of many paintball guns are considerably smaller, mounting the compressed gas tank on a rear portion thereof renders paintball guns unnecessarily unwieldy. Accordingly, for many paintball guns, the compressed gas tank is mounted to a bottom portion thereof. For example, many compressed gas tanks are mounted to a bottom side surface of a central handgrip portion of the paintball gun. While mounting the compressed gas tank to the bottom of the paintball gun has successfully shortened the length of many guns, thereby enabling players to carry the paintball gun, preferably grasped by both hands, forward of the body. This has allowed considerable flexibility in movement. For example, players can aim the paintball gun in a variety of directions without having to pivot the torso.

However, there are also certain disadvantages to positioning the compressed gas tank below the paintball gun. More specifically, by positioning the compressed gas tank in this manner, the vertical profile of the paintball gun is increased substantially. Furthermore, when the compressed gas tank is the lowermost portion of the paintball gun, it often interferes with use of the paintball gun. For example, if a player seeks to lay on the ground and wait for their opponent to come into range, the player will often try to support the paintball gun on the ground. Not only does the compressed gas tank force the paintball gun to sit uncomfortably high, the rounded surface which characterizes most compressed gas tanks will increase the difficulty of keeping the paintball gun level and motionless. Similarly, the increased vertical profile of the paintball gun which results from mounting the compressed gas tank on the bottom surface of the paintball gun can make it easier for an opponent to spot the paintball gun. For example, players will often camouflage themselves behind an object but extend the paintball gun past the edge of the object. If the compressed gas tank is positioned below the remainder of the paintball gun, the paintball gun may be easier to spot. Here, it should be noted that most paintball guns use gravity actuated loaders. As a result, the paintball gun cannot be turned on its side before extending it past the edge of the camouflaging object.

SUMMARY OF THE INVENTION

The present invention, accordingly, provides a paintball gun system which includes a paintball gun having a paintball ejection system and a compressed gas supply system which is both coupled to the paintball ejection system for the supply of gas thereto and movably attached to the paintball gun such that the compressed gas supply system may be moved relative to the paintball gun. An attachment member which couples the two includes a first part having a surface mounted to a lower side surface of the paintball gun and a second part having a surface mounted to an upper side surface of the compressed gas supply system. Preferably, the first part of the attachment member includes a shaft insertably mounted in an aperture formed in the second part of said attachment member. A projection formed on a portion of the shaft which projects through the aperture is seated in a notch formed in a first side surface of said second part to fix the compressed gas tank in a position relative to the paintball gun. Preferably, plural notches are formed in the first side surface of the second part so that the compressed gas tank can be moved, relative to the paintball gun, by reseating the projection in a different notch. By moving the paintball gun relative to the compressed gas supply system, the vertical profile of the paintball gun system may be reduced.

BRIEF DESCRIPTION OF THE DRAWINGS

FIG. 2 is a cross-sectional side view of an attachment member which mounts the compressed gas tank to the bottom surface of the paintball gun; and FIG. 3 is a front view of the attachment member of FIG. 2.

DESCRIPTION OF A PREFERRED EMBODIMENT

Figure 1:
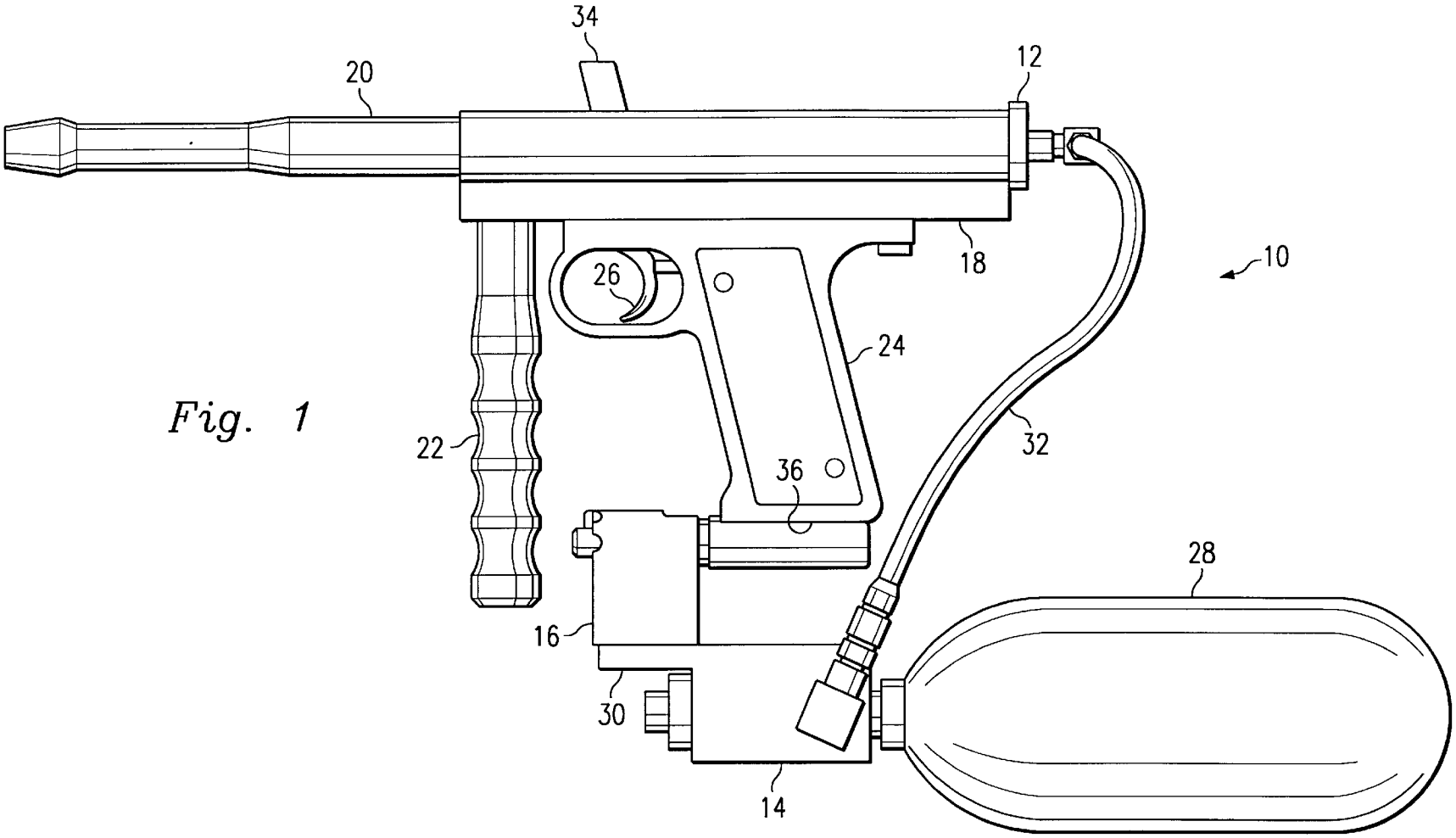
FIG. 1 is a side view of a movable compressed gas tank constructed in accordance with the teachings of the present invention and mounted to a bottom surface of a paintball gun.

Referring first to FIG. 1, a paintball gun system 10 having a rotatable compressed gas tank mounted thereto may now be seen. The paintball gun system 10 includes a paintball gun 12, a compressed gas supply system 14 and an adjustable attachment member 16 which mounts the compresses gas supply system 14 to the paintball gun 12 such that the compressed gas supply system 14 may moved relative to the paintball gun 12.

The adjustable attachment member 16 is suitable for use with a wide variety of conventionally designed paintball guns, one of which is shown in FIG. 1 by way of example. The paintball gun 12 includes a main body portion 18, a barrel 20 supportably mounted on the main body portion 18, a front hand grip 22 depending generally downward from the main body portion 18, a central hand grip 24 having a trigger 26 and also depending generally downward from the main body portion 18. The compressed gas supply system 14 includes a tank 28 of compressed gas, for example, air or $CO_2$, a support member 30 for mounting the compressed gas supply system 14 to the paintball gun 12 and a supply conduit 32 which couples the compressed gas tank 28 to the barrel 20. While not shown in FIG. 1 for ease of illustration, the support member 30 typically includes a valve system coupled to the trigger 26 such that, by depression of the trigger 26, a short burst of gas is supplied to the conduit 32 for delivery to the barrel 20.

The paintball gun 12 is conventionally fitted with an in-feed tube 34 having an interior passageway (not shown) extending therethrough. Preferably, the in-feed tube 34 is angled, relative to the barrel 20 so as to not interfere with aiming of the paintball gun 12. The inner or bottom end of the in-feed tube 34 communicates with a firing chamber (not shown) within the paintball gun 12. In turn, the firing chamber is in operative communication with the compressed air held within the tank 28 via the conduit 32. Paintballs stored within a bulk loader (not shown) mounted to an upper end of the in-feed tube 34 are gravity-fed downwardly into the firing chamber for sequential firing from the barrel 20 of the paintball gun 12 by pressure bursts of compressed gas from the compressed gas tank 28 which are produced by sequential pulls of the trigger 22.

As may be further seen in FIG. 1, by mounting the compressed gas supply system 14 to the bottom of the paintball gun 12, the vertical profile of the paintball gun system 10 is increased considerably. However, since, in accordance with the teachings of the present invention, an adjustable attachment member 16 is used to mount the compressed gas supply system 14 to a bottom side surface 36 of the central hand grip 24, the compressed gas supply system 14, and, in particular, the compressed gas tank 28 may be rotated, relative to the remainder of the paintball gun system 10, to reduce the vertical profile thereof.

Referring to FIG. 2, the configuration of the adjustable attachment member 16 will now be described in greater detail. The adjustable attachment member 16 includes a main body portion 38 and a shaft member 40. Connectors 42, each of which extends through an aperture 46 formed in the support member 30 and into an aperture 48 formed in a bottom side surface 50 of the main body portion 38, mount the compressed gas supply system 14 to the bottom side surface 50 of the main body portion 38. While, in the embodiment of the invention illustrated in FIG. 2, screws which engage threads formed along the interior side surfaces which define the apertures 48 are used as the connectors 42, it should be clearly understood that other types of connectors, for example, welded bolts, would be equally suitable for the uses contemplated herein. Readily removable connectors are preferred, however. The shaft member 40 is mounted to the bottom side surface 36 of the central hand grip 24 in a similar fashion--by connectors 52, for example, screws, which respectively extend through an aperture 54 formed in the shaft member 40 and into an threaded aperture 56 formed in a bottom side surface 36 of the central hand grip 24 of the paintball gun 12. While the shaft member 40 is generally cylindrical in shape, to improve the mount thereof to the central hand grip 24, a notch 57 is formed in the shaft member 40 so that the bottom surface 36 engages a complimentarily shaped, generally flat exposed interior surface 59 of the shaft member 40.

As may be further seen in FIG. 2, the shaft member includes a first portion 62 having a first diameter, a second portion 64 having a second diameter greater than the first diameter and a third portion 66 (in which the notch 57 is formed) having a third diameter greater than the second diameter. A interior passageway 55 extending from a back side surface 38*a* to a front side surface 38*b* and sized to receive part of the shaft member 42 is formed in the main body portion 38 of the adjustable attachment member 16. The interior passageway includes a wider portion 58 having a diameter dimensioned such that the second portion 64 of the shaft member 40 may be slidingly received therein and sufficiently greater than the diameter of the first portion 62 of the shaft member 40 such that a biasing spring member may function therein and a narrower portion 60 having a diameter dimensioned such that the first portion 62 of the shaft member 40 may be slidingly received therein.

The shaft member 40 is spring mounted to the main body portion 38. More specifically, prior to insertion of the shaft member 40 in the interior passageway 55, a biasing spring member 70 is placed over the first portion 62 of the shaft member 40. The shaft member 40 is then inserted into the interior passageway 55. As the spring member 70 is larger than the narrower portion 60 of the interior passageway 55, as the first portion 62 of the shaft member 40 is inserted through the narrower portion 60 of the interior passageway 55, the spring 70 is held within the wider portion 58 of the interior passageway 55 by an interior wall 72 and, as the spring member 70 is compressed between the interior wall 72 and a leading edge 73 of the second portion 64 of the shaft member 40, the spring member 70 begins to exert a force opposing further insertion of the shaft member 40. The shaft member 40 is inserted, against this opposing spring force, a sufficient distance such a leading part of the narrower portion 60 projects through the interior passageway 55 such that an aperture 76 formed in the first portion 62 is exposed and a pin 80 is inserted therein.

As may be seen in FIG. 3, first, second, third, fourth and fifth notches 78-1, 78-78-2, 78-3, 78-4 and 78-5, each of which extends from a peripheral edge of the opening of the interior passageway 55 along the front side surface 38*b* to an outer peripheral edge of the first side surface 38*b* are formed in the main body portion 38. To fixedly secure the shaft 40 in position, spring force exerted by the spring member 70 seats the pin in one of the notches 78-1 through 78-5, thereby securing the compressed gas tank 28 in a selected position relative to the remainder of the paintball gun system 10. To reposition the compressed gas tank 28, a force is exerted on the shaft 48, thereby compressing the spring member 70 between edge surfaces 72 and 73, causing the first portion 62 to project further out from the front side surface 38*b* and unseating the pin 80 from the notch 78-1 through 78-5 in which it had been positioned. While continuing to exert force on the shaft 40, the main body portion 38 is grasped and rotated until the pin 80 is repositioned over another one of the notches 78-1 through 78-5. The shaft 40 is then released. As the spring member 70 expands, it exerts a force against the shaft member 40 which seats the pin 80 in the next notch 78-1 through 78-5.

Again referring to FIG. 3, the various repositionings of the compressed gas tank 28 which may be achieved by unseating the pin 80 and rotating the main body portion 38 and reseating the pin 80 may now be seen. By seating the pin 80 in the notch 78-1, the main body portion 36-1 and the compressed gas tank 28-1 are positioned directly below the paintball gun 12. In this position, the vertical profile of the paintball gun 12 is maximized. By reseating the pin 80 into the notch 78-2, 78-3, 78-4 or 78-5, the main body portion 38 and compressed gas tank 28 may be rotated 45 degrees right, 90 degrees right, 45 degrees left or 90 degrees left, respectively. These alternate positions for the main body portion 38 and the compressed gas tank 28 are shown, in phantom, as main body portion and compressed gas tank 38-2 and 28-2, 38-3 and 28-3, 38-4 and 28-4, and 38-5 and 28-5. By rotating the main body portion 38 and compressed gas tank 28 into any one of these positions, the vertical profile of the paintball gun system is reduced substantially. Furthermore, the player may now more easily support the paintball gun system 10 on the ground or other horizontal surface. It should be understood, however, that, in the embodiment of the invention disclosed herein, the notches are positioned such that the compressed gas tank may be rotated either 45 or 90 degrees in either direction. Other degrees of rotations would be possible by repositioning the notches to other locations. However, so that the compressed tank 28 may be positioned to the left or right of the paintball gun system 10, for example when holding the paintball gun system 10 around either a right or left corner, respectively, it is preferred that the sufficient notches be provided such that the compressed gas tank 28 may be rotated both left and right.

Although illustrative embodiments of the invention have been shown and described, other modifications, changes, and substitutions are intended in the foregoing disclosure. Accordingly, it is appropriate that the appended claims be construed broadly and in a manner consistent with the scope of the invention.

What is claimed is:

1. A paintball gun system, comprising:

a paintball gun having a paintball ejection system; and a compressed gas supply system coupled to said paintball ejection system for supply of gas thereto, said compressed gas supply system mated to said paintball gun such that said compressed gas supply system may be rotated, relative to said paintball gun, through a series of at least two mating positions while coupled to said paintball ejection system, wherein, in each one of said series of at least two mating positions, said compressed gas supply system is mated to said paintball gun in a different fixed position relative to said paintball gun.

2. A paintball gun system according to claim 1 wherein said paintball gun system has a vertical profile and wherein movement of said compressed gas supply system reduces said vertical profile of said paintball gun supply system.

3. A paintball gun system according to claim 1 wherein said paintball gun has a lower side surface and said compressed gas supply system is movably attached to said lower side surface.

4. A paintball gun system according to claim 3 wherein said compressed gas supply system further comprises a compressed gas tank and said compressed gas supply system is movably attached to said lower side surface such that said compressed gas tank may be positioned below said paintball gun.

5. A paintball gun system according to claim 1 wherein said paintball gun further comprises a hand grip having a bottom side surface, said compressed gas supply system movably attached to said bottom side surface of said hand grip.

6. A paintball gun system according to claim 5 wherein said paintball gun system has a vertical profile and wherein movement of said compressed gas supply system reduces said vertical profile of said paintball gun supply system.

7. A paintball gun system according to claim 6 wherein said paintball gun has a lower side surface and said compressed gas supply system is movably attached to said lower side surface.

8. A paintball gun system according to claim 7 wherein said compressed gas supply system further comprises a compressed gas tank and said compressed gas supply system is movably attached to said lower side surface such that said compressed gas tank may be positioned below said paintball gun.

9. A paintball gun system according to claim 8 wherein said paintball gun and said compressed gas supply system, when positioned below said lower side surface, are positioned along a common axis and wherein said compressed gas canister may be repositioned up to 90 degrees off said common axis by moving said compressed gas supply system.

10. A paintball gun system, comprising:

a paintball gun having a paintball ejection system incorporated therein, said paintball gun having a lower side surface;

a compressed gas supply system coupled to said paintball ejection system for supply of gas thereto, said compressed gas supply system having an upper side surface;

an attachment member coupling said paintball gun and said compressed gas supply system, said attachment member including a first part having a surface mounted to said lower side surface of said paintball gun and a second part having a surface mounted to said upper side surface of said compressed gas supply system;

said first and second parts of said attachment member mated together such that said first part may be moved, relative to said second part, between at least two mating positions;

wherein, in each one of said at least two mating positions, said compressed gas supply system is in a different fixed location relative to said paintball gun.

11. A paintball gun system, comprising:

a paintball gun having a paintball ejection system incorporated therein, said paintball gun having a lower side surface;

a compressed gas supply system coupled to said paintball ejection system for supply of gas thereto, said compressed gas supply system having an upper side surface; and an attachment member coupling said paintball gun and said compressed gas supply system, said attachment member including a first part having a surface mounted to said lower side surface of said paintball gun and a second part having a surface mounted to said upper side surface of said compressed gas supply system;

said first part of said attachment member including a shaft insertably mounted in an interior passageway formed in said second part of said attachment member;

said second part of said attachment member being rotable, on said shaft between at least two positions;

wherein in each of said at least two positions, said compressed gas supply system is in a different fixed position relative to said paintball gun.

12. A paintball gun system, comprising:

a paintball gun having a paintball ejection system incorporated therein, said paintball gun having a lower side surface;

a compressed gas supply system coupled to said paintball ejection system for supply of gas thereto, said compressed gas supply system having an upper side surface; and an attachment member coupling said paintball gun and said compressed gas supply system, said attachment member including a first part having a surface mounted to said lower side surface of said paintball gun and a second part having a surface mounted to said upper side surface of said compressed gas supply system;

said first part of said attachment member including a shaft insertably mounted in an interior passageway formed in said second part of said attachment member;

wherein an outwardly extending pin is received in a corresponding aperture formed in a portion of said shaft which projects through said interior passageway, said pin being seated in a first notch formed in a first side surface of said second part.

13. A paintball gun system according to claim 12 and further comprising a spring member which biases said pin into said notch.

14. A paintball gun system according to claim 12 wherein a plurality of notches are formed in said first side surface of said second part and wherein said second part may be repositioned relative to said second part by unseating said pin from said first notch and reseating said pin in a selected one of said plurality of second notches.

15. An apparatus according to claim 14 and further comprising a spring member which biases said pin into said notch in which said pin is seated.

16. A paintball gun system, comprising:

a paintball gun having a side surface;

a compressed gas supply system having a side surface;

an attachment member coupling said paintball gun and said compressed gas supply system, said attachment member including a first part having a surface mounted to said side surface of said paintball gun and a second part having a surface mounted to said side surface of said compressed gas supply system;

said first and second parts of said attachment member mated together such that a selected one of said first and second parts may be moved, relative to the other of said first and second parts, between at least two mating positions;

wherein, in each one of said at least two mating positions, said compressed gas supply system is in a different fixed position relative to said paintball gun.

* * * * *